United States Patent [19]

Nakamori

[11] Patent Number: 5,076,110

[45] Date of Patent: Dec. 31, 1991

[54] CAM CONTROL MECHANISM OF A CARRIAGE IN A FLAT KNITTING MACHINE

[75] Inventor: Toshinori Nakamori, Wakayama, Japan

[73] Assignee: Shima Seiki Mfg., Ltd., Wakayama, Japan

[21] Appl. No.: 622,685

[22] Filed: Dec. 5, 1990

[30] Foreign Application Priority Data

Dec. 8, 1989 [JP] Japan ..... 1-319104

[51] Int. Cl.[5] ..... F16H 21/44; D04B 15/66

[52] U.S. Cl. ..... 74/110; 66/75.2

[58] Field of Search ..... 74/55, 110; 66/75.2, 66/218

[56] References Cited

U.S. PATENT DOCUMENTS 4,429,553 2/1984 Frund et al. ..... 66/75.2 X
4,554,802 11/1985 Goller et al. ..... 66/75.2 X
4,615,187 10/1986 Schimko ..... 66/75.2

FOREIGN PATENT DOCUMENTS 796868 4/1936 France ..... 74/110

*Primary Examiner*—Leslie A. Braun
*Assistant Examiner*—David W. Laub
*Attorney, Agent, or Firm*—Edwin E. Greigg; Ronald E. Greigg

[57] ABSTRACT

The invention relates to a cam control mechanism of a carriage in a flat knitting machine capable of controlling vats with different heights from the carriage depending on the requirement, without having to mount plural solenoids on the carriage for controlling vats with different heights on the jacks for composing the knitting needles in a flat knitting machine.

2 Claims, 1 Drawing Sheet

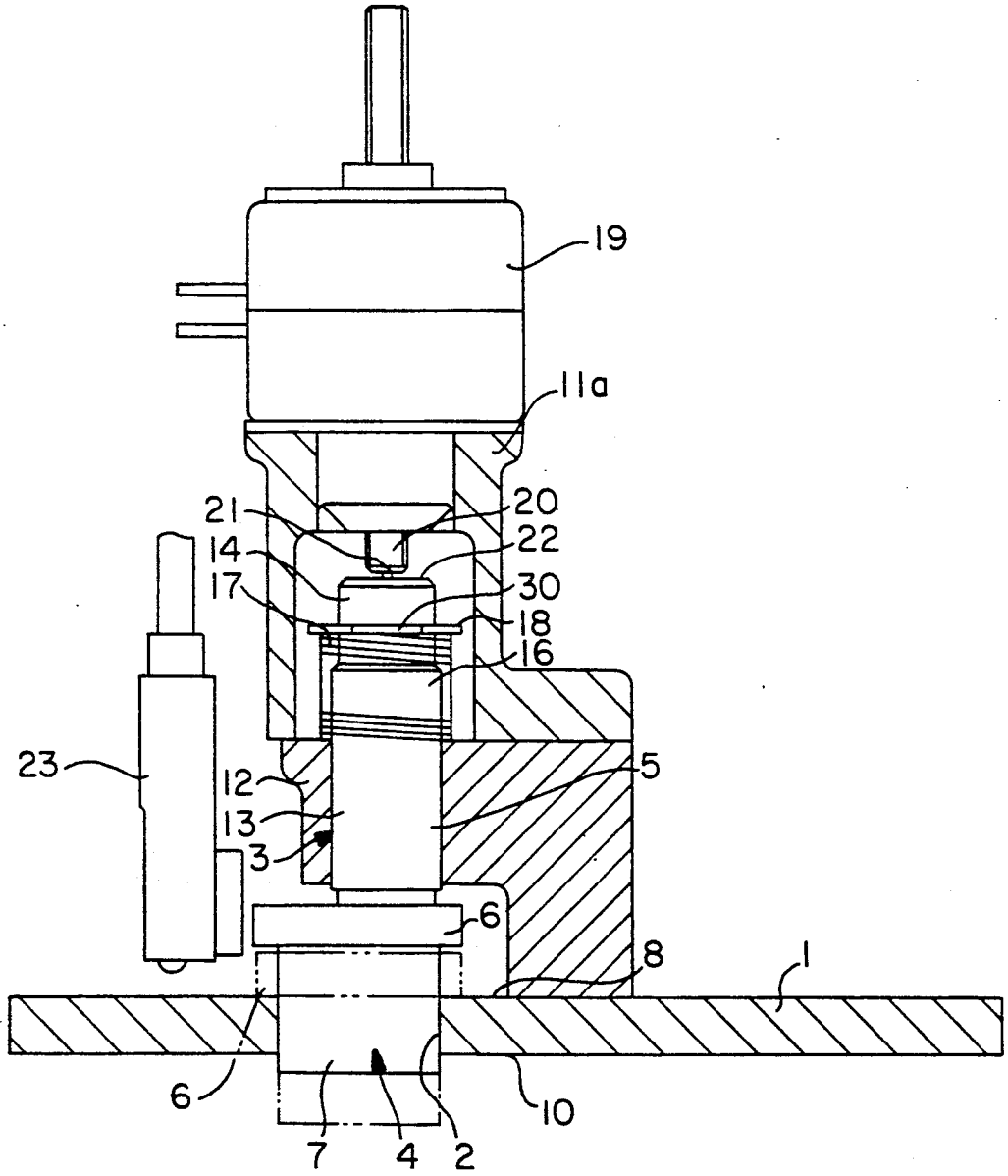
19
11a
21
20
22
14
30
17
18
16
23
12
5
13
3
6
8
1
6
10
7
4
2

CAM CONTROL MECHANISM OF A CARRIAGE IN A FLAT KNITTING MACHINE

BACKGROUND OF THE INVENTION

The present invention relates to a cam control mechanism of a carriage in a flat knitting machine.

When knitting a fabric by a flat knitting machine, a cam is caused to act (inact) on the vat of one jack composing knitting needles from a carriage running right and left above the needle bed, and the motion of the needles is manipulated by controlling the convex vats of different heights formed on each jack.

That is, hitherto, jacks with large (tall) vats and jacks with small (short) vats were combined, or jacks with large vats, jacks with medium (of medium height of large and small vats) vats, and jacks with small vats were combined, and the cam was caused to act on vats of jacks of different combinations by disposing two or three solenoids on the carriage to actuate the solenoids, thereby causing the cams to act on large and small vats, or large, medium and small vats.

Accordingly, in order to control the jacks forming large and small, or large, medium and small convex vats as required, two or three solenoids were needed, and mounting of these solenoids on the carriage complicated the internal structure of the carriage, and the weight of the carriage which runs becomes heavy, and in the carriage repeating running, inverting and stopping, adverse effects due to inertia when stopping could not be disregarded.

OBJECT AND SUMMARY OF THE INVENTION

The invention is developed in the light of such problems, and it is a primary object thereof to present a cam control mechanism of a carriage in a flat knitting machine capable of controlling vats of various heights with a cam from the carriage, without mounting plural solenoids on the carriage.

BRIEF DESCRIPTION OF THE DRAWING

The drawing is an explanatory diagram of a section of an embodiment of the invention.

DETAILED DESCRIPTION OF THE PREFERRED EMBODIMENT

Referring now to the drawing, an embodiment of the invention is described below.

Numeral 1 is a bottom plate of a carriage in a flat knitting machine, and an opening 2 is made in this bottom plate 1 of the carriage. This opening 2 is intended for moving an actuating part 4 of a cam 3 in and out. The cam 3 abuts against a vat of a jack (not shown), for example, disposed parallel on the needle bed to control this jack. The cam 3 is formed in one body by the actuating part 4 and shaft part 5.

The actuating part 4 of the cam 3 is composed of a flange 6 positioned inside of the carriage of the bottom plate 1, and a protrusion 7 projecting from the opening 2. While the flange 6 is abutting against the inside surface 8 of the bottom plate 1, the protrusion 7 of the actuating part 4 is projecting more than half from the outside surface 10 of the bottom plate 1 as shown in dotted line in the drawing.

The cam 3 is disposed in a state in which the shaft part 5 is erect on the flange 6 of the actuating part 4. In order to support this shaft part 5 freely movable in the vertical direction, a support bracket 11 is set up on the bottom plate inside surface 8 in the carriage. The support bracket 11 is disposed in the bottom plate 1 on an inverted L-section, and a penetration hole 13 is drilled in a convex part 12 so as to insert the shaft part 5 of the cam 3.

The shaft part 5 of the ca 3 is inserted in this penetration hole 13, and its upper end part 14 projects upward from the top 15 of the convex part 12 of the support bracket 11. A spring 17 is fitted freely onto the projection 16 of the shaft part 5, and is arranged so that on end may abut against the top 15 of the convex part 12.

Furthermore, near the upper end of the projection 16 of the shaft part 5, a flange 18 made of C-type or E-type clips is provided, and the other end of the spring 17 is abutting against this flange 18, by the elastic thrusting of the spring 17, the cam 3 is always thrust upward. The C-type clip is formed in the shape of a "C" and the E-type clip is formed in the shape of an "E". In order for the clips to support the spring, the clip is forced into an annular groove 30 in the upper end part 14.

A bracket **11*a* for supporting a step motor 19 mentioned below is disposed on the support bracket 11. The step motor 19 is mounted on the upper part of the bracket 11*a*, so that a main shaft 20 of the step motor 19 may extend downwardly. A front end 21 of the main shaft 20 is designed to abut against the front end 22 of the upper end 14 of the shaft part 5 of the cam 3. The main shaft 2 of the step motor 19 is designed to move up and down as it rotates, when operating. Numeral 23 is a sensor, which detects the preset zero point position of the cam 3 when power is on, and if the stated portion of the cam 3 (for example, the stated portion of the flange 6) is not at the corresponding position to the detecting portion of the sensor 23, no signal detecting the stated portion of the cam 3 is put out from the sensor 23. In this case, the step motor 19 is operated to move the cam 3 up or down, and when the stated portion of the cam 3 is detected, the movement of the step motor 19 stops. Thus the stated portion of the cam 3 (the zero point or rest position) is always kept at the corresponding position to the detecting portion of the sensor 23**.

The necessary length of the projecting portion of the protuberance 7 of the cam 3 from the bottom plate 1 is calculated in an arithmetic sequence unit (not shown in the figure) according to a type of each knitting. The main shaft 20 of the step motor 19 is moved downward by a specified length through the arithmetic sequence unit and the protuberance 7 of the cam 3 will be projected by a specified length from the opening 2 of the bottom plate 1 according to the arithmetic sequence.

In this way, the sensor 23 controls the projecting length of the protuberance 7 from the bottom 1 according to a type of each knitting. Further, sensor 23 may be used as a monitor to detect and confirm the nonoperative state of the cam 3.

By this composed cam control mechanism of a carriage in a flat knitting machine, by actuating the main shaft 20 by sending a pulse signal to the step motor 19, the main shaft 20 rotates, and ascends or descends.

As the main shaft 20 is lowered, the cam 3 which has been thrust upward by the elastic force of the spring 17 is pushed downward by resisting the elastic thrusting force of the spring 17, and the protuberance 7 of the cam 3 is projected downward below the bottom plate 1 of the carriage by a specified length from the opening 2 of the bottom plate 1.

When the protuberance 7 of the cam 3 is projected the most from the bottom plate 1, it acts on the vat which is a large or small convex part of the jack, thereby controlling the needle.

Besides, sending a pulse signal to the step motor 19, the main shaft 20 is actuated to raise the main shaft 20 slightly, so that the cam 3 is thrust upward by the elastic force of the spring, and the entire cam 3 goes up slightly. In consequence, the protuberance 7 is slightly set back into the opening 2 of the carriage. In this state, the cam 3 does not act on the vat having a small convex part of the jack, but acts on the vat having the large convex part, thereby controlling this jack.

Furthermore, a pulse signal is sent to the step motor 19 to actuate the main shaft 20, and the main shaft 20 is raised, and when the cam 3 is raised most to the carriage side, the projection of the protuberance 7 of the cam 3 from the opening 2 is small, and in this state the protuberance 7 of the cam 3 does not act on the jack of the vat having large and small convex parts.

By operating the step motor 19 in this manner to move the main shaft 20 up and down, the cam 3 is moved up and down, and by controlling the projecting length of the cam from the carriage bottom plate 1 the jack of the vat having large and small convex parts can be controlled.

In the foregoing explanation, the jack of the vat having large and small convex parts is controlled but the cam control mechanism of the invention may be applied to easily control not only the jack with large and small vats as mentioned herein, but also the jack with large, medium and small convex vats, or jacks with vats of various different height aside from large, medium and small sizes. Control of the different sized jacks depends upon the length of the protuberance 7 below the bottom surface of the bottom plate 1.

What is claimed is:

1. A cam control mechanism of a carriage in a flat knitting machine, said carriage includes a bottom plate, an opening in said bottom plate of said carriage, a cam composed of an actuating part and a shaft part disposed with the actuating part of the cam projecting out from said opening below said bottom plate, a support bracket disposed for supporting the shaft part freely movable in a vertical direction in the opening in said carriage, a spring, one end of said spring freely fitted to the shaft part abuts against the support bracket, the other end of said spring abuts against a flange disposed on the shaft part, the cam is thrust upward by an elastic force of the spring, a step motor mounted on a front end of the shaft part by means of the support bracket, said motor including a main shaft above said front end of said shaft part, said main shaft having a front end so that the front end of the main shaft of the step motor abuts against the front end of the shaft part, and the cam is controlled in the vertical direction by a vertical and rotational motion of the main shaft due to actuation of the main shaft by the step motor.

2. A cam control mechanism as set forth in claim 1 which includes a sensor disposed juxtaposed said cam for determining a zero or rest position of said cam.

* * * * *